United States Patent [19]

Auschrat

[11] Patent Number: 4,634,348

[45] Date of Patent: Jan. 6, 1987

[54] LIQUID RING COMPRESSOR HAVING A PASSAGEWAY IN DISCHARGE PORT FOR INTRODUCING AIR

[75] Inventor: Siegfried Auschrat, Heiligenstedten, Fed. Rep. of Germany

[73] Assignee: Sihi GmbH & Co. KG, Itzehoe, Fed. Rep. of Germany

[21] Appl. No.: 782,202

[22] Filed: Sep. 30, 1985

[30] Foreign Application Priority Data

Oct. 1, 1984 [DE] Fed. Rep. of Germany ..... 3436022

[51] Int. Cl.[4] ..... F04C 19/00

[52] U.S. Cl. ..... 417/68

[58] Field of Search ..... 417/68, 69

[56] References Cited

U.S. PATENT DOCUMENTS

| | | | |
|---|---|---|---|
| 1,180,613 | 4/1916 | Siemen | 417/68 |
| 3,366,314 | 1/1968 | Schroder | 417/68 |
| 4,083,658 | 4/1978 | Ramm | 417/68 |
| 4,565,498 | 1/1986 | Schmid et al. | 417/68 |

FOREIGN PATENT DOCUMENTS

| | | | |
|---|---|---|---|
| 51080 | 12/1935 | Denmark | 417/68 |
| 2064002 | 6/1981 | United Kingdom | 417/68 |

*Primary Examiner*—William L. Freeh
*Assistant Examiner*—Paul F. Neils
*Attorney, Agent, or Firm*—Prutzman, Kalb, Chilton & Alix

[57] ABSTRACT

In a liquid ring compressor, the erosion and cavitation damage occurring under certain operating conditions is avoided by adding air or gas from the outside, at a pressure which approximately corresponds to the compression pressure, into particular pressure slot areas.

7 Claims, 5 Drawing Figures

LIQUID RING COMPRESSOR HAVING A PASSAGEWAY IN DISCHARGE PORT FOR INTRODUCING AIR

Figure 2:
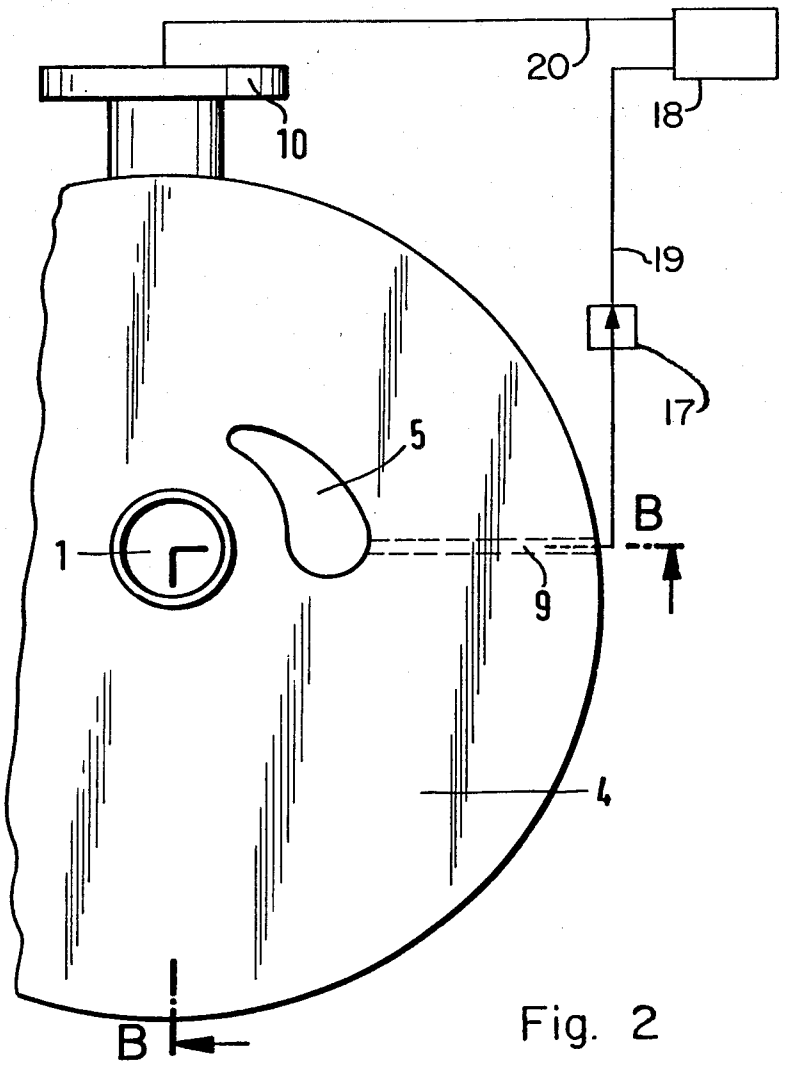
Figure 1:
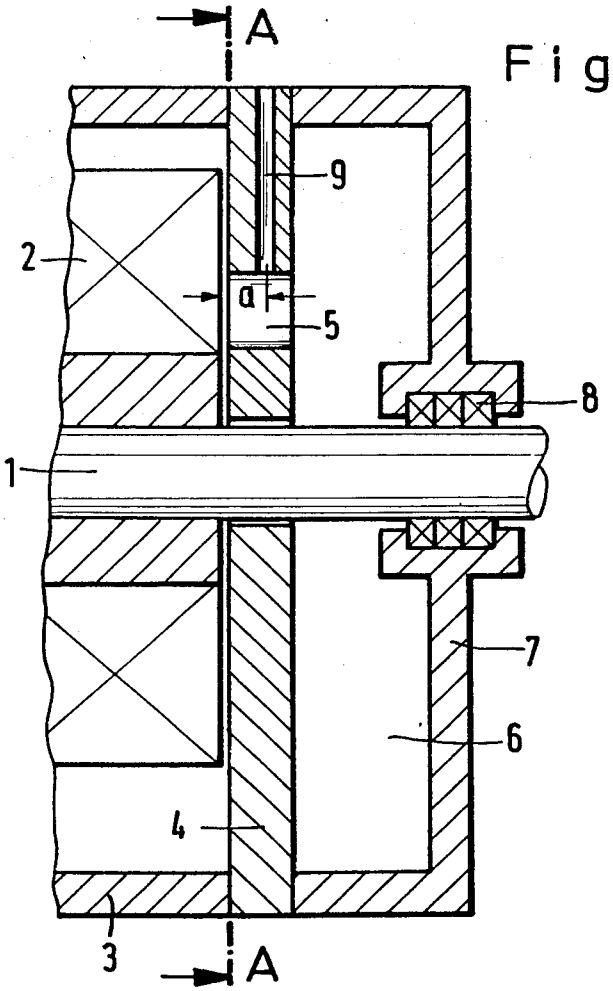
Figure 4:
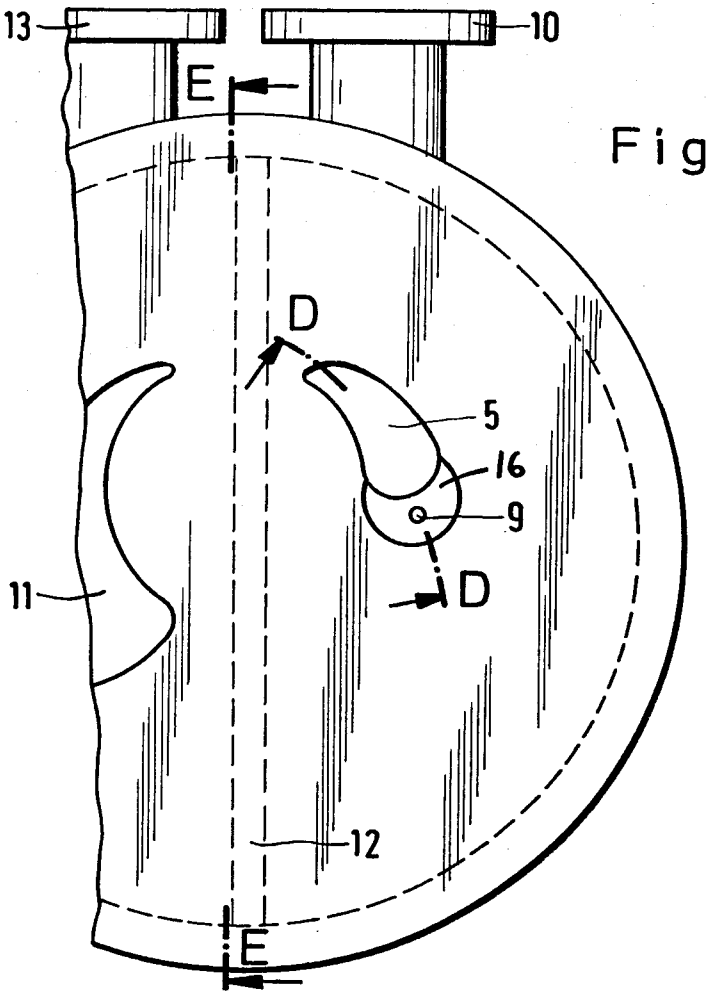
Figure 3:
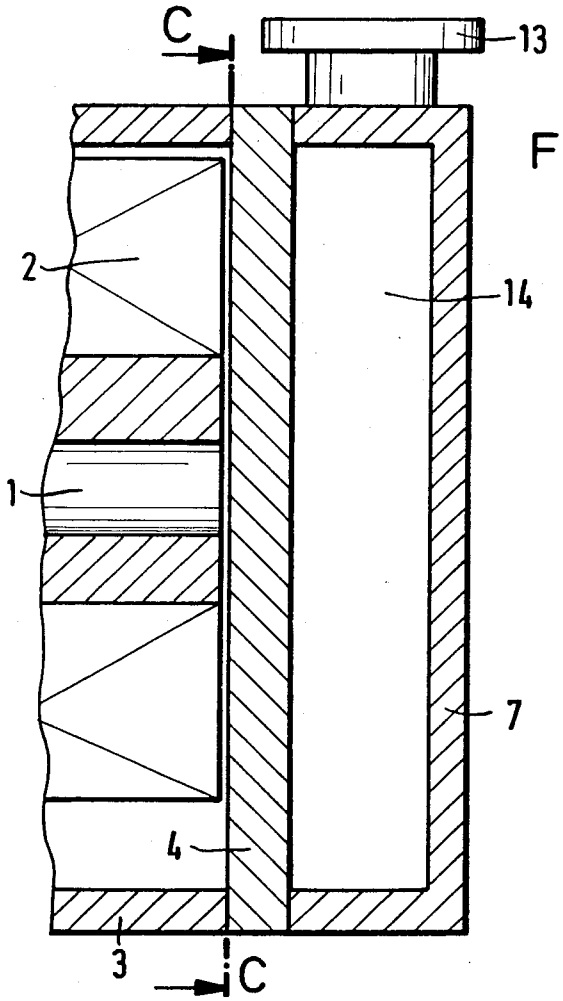
Figure 5:
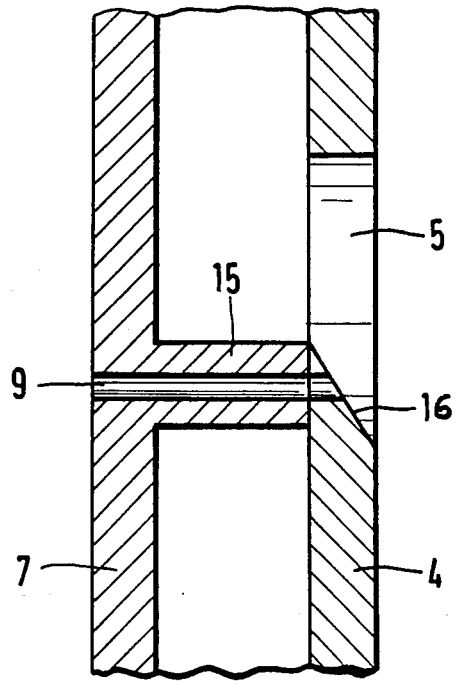

The invention relates to a liquid ring compressor in particular for the operating range of suction pressures below 1 bar, having a control disk which is arranged closely adjacent to at least one end face of the impeller of the last compressor stage and has a pressure passage for the delivery medium.

The minimum suction pressures to be reached by the compressors depend on the one hand on the design of such compressors, and on the other hand also on the vapour pressure of the medium used as an operating fluid. If a compressor is operated with suction-side pressure which is close to the vapour pressure of the operating fluid, the mass flow of gas, which is delivered by the pump, becomes correspondingly low and the vapour portion arising on the compressor suction side becomes correspondingly large. Cavitation phenomena finally develop in the compressor which especially appear at the control disk in the area of the pressure passage of the necessary last compressor stage and at the impellers. The cause of this is that a relatively high vacuum still exists when there are such minimum mass flows in the vane cells shortly before opening towards the pressure chamber of the compressor of the last compressor stage. In the pressure chamber itself—since there is hardly any mass flow—fluid collects and this finally also covers the initial area of the pressure passage, so that, when the impeller vane cells are opened towards the pressure chamber, a sudden return flow of fluid develops through the pressure passage into the vane cell, and at the same time such high velocities are reached that erosion damage occurs on the one hand at the vane and pressure passage edges and that vaporization occurs and the vapour bubbles, when entering into the vane cells and when the pressure then increases, collapse again and cause the undesirable cavitation damage.

Attempts have hitherto been made to prevent this, for example, by adding air or gas from the outside on the compressor suction side or, in the case of multi-stage compressors, between the stages, which, however, has the disadvantage that the compressor performance is thus negatively affected when this gas or air is added.

Moreover, it is very difficult to correctly control the addition of air or gas, because the air or gas must be added at very precise suction pressures of the compressor, and correspondingly sensitive valves which operate in narrow pressure ranges are very expensive and elaborate and, moreover, are also very sensitive.

Attempts have also been made to avoid cavitation and erosion damage in these compressors by discharging fluid and gas separately out of the pressure chamber of the compressors, especially at high vacuums, and thus keeping the pressure passage completely free of fluid even at low suction pressures of the compressor, that is, at low mass flows. The disadvantage in this connection is that the separate discharge of gas and fluid from the pressure chamber of the compressor is correspondingly expensive and control also has to be provided which enables the separate discharge to take effect smoothly, especially at low suction pressures.

In a further embodiment, in a special compressor having a vertical shaft, the feedback of gas or air into the pressure chamber of the compressor is known; but this is a measure which has only brought partial success or has proved fully ineffective in other compressors.

To avoid the disadvantages, it is therefore proposed according to the invention, in the case of the liquid ring compressor, as seen in the direction of rotation, to arrange an opening in the first quarter of the last compressor stage pressure passage part which cannot be covered by valves or flaps, which opening is directly connected to a gas/air chamber in which approximately the compression pressure of the compressor is present. As used herein, the term "last compressor stage" should be understood to mean the compressor stage of a single stage compressor, or the last compressor stage of a multi-stage compressor. At low mass flows of the compressor, there is a slight vacuum in this area of the pressure passage, which vacuum is caused by the continuous opening of the impeller vane cells, in which the final compressor pressure has still not been reached. The gas or the air flowing in because of the vacuum then prevents fluid in this area from flowing back into the impeller vane cells and thus of course also prevents the above described cavitation and erosion damage.

It is further proposed to connect the opening leading into the pressure passage of the compressor stage to the gas chamber of the separator vessel connected on the outlet side of the compressor. In this way, pressure can be made available at this point in the pressure passage in a particularly simple manner, which pressure approximately corresponds to the compression pressure of the compressor.

It has also been shown to be advantageous to remotely arrange the opening in the pressure passage of the last compressor stage at a distance from the end face of the impeller, which distance corresponds approximately to a thickness of the impeller vane or slightly less in the area of the pressure passage. If the opening is arranged too close to the impeller end face, disturbing flow noises become apparent. If the opening is removed too far from the end face of the impeller, a portion of the cavitation-inhibiting and erosion-inhibiting effect is lost.

A preferred point for leading the opening into the pressure passage of the last compressor stage is the radially outer termination of the pressure passage of the control disk. From here, the opening can be led outwards through the control disk in a particularly simple form and from here via an external connection to a chamber in which approximately the final pressure of the compressor is present.

A further preferred embodiment of the invention is the arrangement of the opening in the pressure passage of the last compressor stage in the sloping surface, which if necessary is present in this area, of the radial pressure passage termination which is made approximately straight or also curved. In this arrangement, on the one hand, the opening can be brought very close to the start of the pressure passage and, on the other hand, because of the corresponding position of the opening, the distancing from the end face of the impeller can also be established exactly.

A particularly simple embodiment of the invention can also be seen in making the opening in the pressure passage of the last compressor stage as a simple bore. As can easily be seen, this causes the minimum of difficulties with regard to production.

To prevent the escape of fluid and gas during operation of the compressor with greater mass flows through the opening in the pressure passage of the last compressor stage, it is proposed to install a non-return valve into the connecting line towards the outside. This would then clear the path for gas or air into the compressor each time during corresponding operating conditions, that is, during correspondingly low suction pressures of the compressor.

The invention is described by way of example with reference to the attached drawings.

FIG. I shows a partial cross section through a compressor along section line BB in FIG. II.

FIG. II shows a partial plan view of the control disk of the compressor along section line AA in FIG. I.

FIG. III shows the partial cross section through a compressor, with suction and pressure connecting pieces arranged on a compressor side, along section line EE in FIG. IV.

FIG. IV shows a partial plan view of the control disk along section line CC in FIG. III. FIG. V shows a detail to an increased scale along section line DD in FIG. IV.

In FIG. I, the impeller 2 is fixed on the shaft 1, which impeller 2 rotates in the housing 3 and is defined at the end face by the control disk 4.

In the control disk 4 is located the pressure passage 5 which connects the impeller vane cells to the pressure chamber 6 which is defined by the pressure housing 7. The shaft outlet to the outside is sealed by a packing 8. According to the invention, the opening 9 is arranged in the control disk 4 at a distance a from the end face of the impeller, with this distance approximately corresponding to an impeller vane width or less in the pressure passage area.

In FIG. II, the shaft 1 can again be seen and also, in plan view, the control disk 4 with the pressure passage 5 arranged therein. The pressure passage 5 can be seen to extend azimuthally for a limited distance on the cntrol disk. The bore 9 leading in the control disk to the pressure passage is shown as a dotted line and, as can be seen here, leads into the first quarter of the pressure passage viewed azimuthally in the direction of impeller rotation. Fluids expelled from the impeller vane cells and also gas leaves compressor through the pressure connecting piece 10.

Partial sections of a compressor are shown in FIGS. III to IV, in which compressor suction and pressure connecting pieces are arranged on one compressor side. The impeller 2 is again fixed on the shaft 1 and the pump delivery chamber is defined on the one hand by the housing 3 and at the impeller end face by the control disk 4. The compressor housing 7 contains both the suction connecting piece 13 and the pressure connecting piece 10 of the compressor and is subdivided by the rib 12 into the suction chamber 14 and the pressure chamber 6. The gas flows through the suction passage 11 into the impeller vane cells and leaves them again through the pressure passage 5. Moreover, the start of the pressure passage 5 is made as a sloping surface 16 and leading into this is the opening 9 according to the invention which is led outwards through an appropriate housing dog 15. A non-return valve 17 can then be arranged into the bore 9 or also into the connecting line adjoining the latter, which non-return valve prevents the escape of fluid from the pump cells to the outside if the pump delivers at greater mass flows in the operating ranges. A separator vessel 18 is connected by line 19 to the opening 9, and by line 20 to the compressor pressure outlet 10. The non-return valve 17 is installed in the connecting line 19.

I claim:

1. A liquid ring compressor, in particular for the operating range of suction pressures below one bar, said compressor including a drive shaft, a pressure chamber, a suction chamber, at least one control disk disposed between said suction chamber and said pressure chamber, a suction inlet passage and a vane impeller driven by said shaft, said impeller having an end face adjacent the control disk of the last compression stage, said control disk having a pressure passage for the operating fluid, and said pressure passage extending azimuthally for a limited distance on said control disk, characterized in that an opening is arranged in the first quarter of the pressure passage as viewed azimuthally in the direction of impeller rotation, which opening is spaced from the impeller end face and is directly connected to a gas/air chamber in which approximately the compression pressure of the compressor is present.

2. The liquid ring compressor according to claim 1, further including a separator vessel connected on the outward side of the compressor, characterized in that the opening leading into the pressure passage is connected to the gas chamber of the separator vessel.

3. The liquid ring compressor according to claim 1 or 2, characterized in that the opening in the pressure passage is arranged at a distance from the end face of the impeller, which distance corresponds approximately to a vane thickness or less of the impeller in the area of the pressure passage.

4. The liquid ring compressor according to claim 1 or 2, wherein said pressure passage has a maximum radially outer extent, characterized in that the opening in the pressure passage leads into the maximum radially outer extent of the pressure passage in the control disk.

5. The liquid ring compressor according to claims 1 or 2, wherein the control disk has a sloped surface defining at least a portion of said pressure passage and wherein said compressor is characterized in that the opening in the pressure passage leads into the sloping surface.

6. The liquid ring compressor according to claims 1 or 2, characterized in that the opening in the pressure passage is made as a simple bore.

7. The liquid ring compressor according to claims 1 or 2, characterized in that a non-return valve is installed in the connection between the opening in the pressure passage and said gas/air chamber.

* * * * *